US007052381B1

(12) United States Patent
Wang

(10) Patent No.: US 7,052,381 B1
(45) Date of Patent: May 30, 2006

(54) BELT SANDER HAVING TENSION ADJUSTMENT MECHANISM

(75) Inventor: Tien Wang Wang, Taichung (TW)

(73) Assignee: Mao Shan Machinery Industrial Co., Ltd., Taiping (TW)

( * ) Notice: Subject to any disclaimer, the term of this patent is extended or adjusted under 35 U.S.C. 154(b) by 0 days.

(21) Appl. No.: 11/080,189

(22) Filed: Mar. 15, 2005

(51) Int. Cl.
*B24B 21/00* (2006.01)

(52) U.S. Cl. ..... 451/311; 451/296

(58) Field of Classification Search ..... 451/311, 451/296, 297, 513
See application file for complete search history.

(56) References Cited

U.S. PATENT DOCUMENTS 3,354,588 A * 11/1967 Roehrig ..... 451/1
4,021,970 A * 5/1977 Przygocki ..... 451/311
4,313,285 A * 2/1982 Jonasson ..... 451/296
5,165,203 A * 11/1992 Chuang ..... 451/297
5,185,963 A * 2/1993 De brey ..... 451/311
6,095,129 A * 8/2000 Kanemichi et al. ..... 125/16.02
6,733,372 B1 * 5/2004 Lin ..... 451/65
6,736,697 B1 * 5/2004 Lienard ..... 451/5
6,769,974 B1 * 8/2004 Wang ..... 451/311
6,855,038 B1 * 2/2005 Caporusso ..... 451/311

* cited by examiner

*Primary Examiner*—Eileen P. Morgan
(74) *Attorney, Agent, or Firm*—Charles E. Baxley

(57) ABSTRACT

A belt sander includes a frame, a support seat, a first wheel rod, a second wheel rod, a sand belt, an adjusting unit, and an operation unit. Thus, the operation handle of the operation unit is rotated to rotate the drive shaft which rotates the drive bevel gear which rotates the driven bevel gear which rotates the driven shaft which rotates the threaded rod to move the slide rod by rotation of the threaded rod so that the slide rod moves the support seat relative to the frame to move the first wheel rod relative to the second wheel rod to change the distance between the first wheel rod and the second wheel rod so as to adjust the tension of the sand belt.

20 Claims, 6 Drawing Sheets

BELT SANDER HAVING TENSION ADJUSTMENT MECHANISM

BACKGROUND OF THE INVENTION

1. Field of the Invention

The present invention relates to a belt sander, and more particularly to a belt sander having a tension adjustment mechanism.

2. Description of the Related Art

A conventional belt sander comprises a frame, a first wheel rod mounted on a first end of the frame, a second wheel rod mounted on a second end of the frame, and a sand belt mounted between the first wheel rod and the second wheel rod. Thus, the sand belt is driven by the first wheel rod and the second wheel rod to rotate at a high speed to grind a workpiece, such as a wooden material. When the sand belt is worn out, the sand belt is cut to detach from the first wheel rod and the second wheel rod for replacement of a new sand belt. However, the tension of the sand belt of the conventional belt sander cannot be adjusted, thereby decreasing greatly the working efficiency of the belt sander and the lifetime of the sand belt. In addition, it is not easy to mount the sand belt between the first wheel rod and the second wheel rod, thereby causing inconvenience to the user when replacing the sand belt.

SUMMARY OF THE INVENTION

The present invention is to mitigate and/or obviate the disadvantage of the conventional belt sander.

The primary objective of the present invention is to provide a belt sander having a tension adjustment mechanism that is operated easily and conveniently, thereby facilitating a user adjusting the tension of the sand belt.

Another objective of the present invention is to provide a belt sander, wherein the operation handle is rotated to rotate the drive shaft which rotates the drive bevel gear which rotates the driven bevel gear which rotates the driven shaft which rotates the threaded rod to move the slide rod by rotation of the threaded rod so that the slide rod is moved upward and downward to move the support seat upward and downward relative to the frame to move the first wheel rod relative to the second wheel rod to change the distance between the first wheel rod and the second wheel rod so as to adjust the tension of the sand belt.

A further objective of the present invention is to provide a belt sander, wherein the user only needs to rotate the operation handle of the operation unit to change the distance between the first wheel rod and the second wheel rod so as to adjust the tension of the sand belt, thereby facilitating the user adjusting the tension of the sand belt, and thereby enhancing the working efficiency of the belt sander.

A further objective of the present invention is to provide a belt sander, wherein the user only needs to rotate the operation handle of the operation unit to shorten the distance between the first wheel rod and the second wheel rod so as to loosen the sand belt, thereby facilitating the user replacing the sand belt, and thereby enhancing the lifetime of the sand belt.

In accordance with the present invention, there is provided a belt sander, comprising:

a frame including a first side plate, a second side plate spaced from the first side plate, a first transverse plate mounted between the first side plate and the second side plate, and a second transverse plate mounted between the first side plate and the second side plate and spaced from the first transverse plate;

a support seat movable relative to the frame;

a first wheel rod mounted on the support seat to move therewith;

a second wheel rod mounted on the frame;

a sand belt mounted between the first wheel rod and the second wheel rod;

an adjusting unit including a driven shaft rotatably mounted on the second transverse plate of the frame, a driven bevel gear secured on the driven shaft to rotate the driven shaft, a threaded rod secured on the driven shaft to rotate therewith, and a slide rod mounted on and movable by rotation of the threaded rod and having a top end secured on a bottom face of the support seat to move the support seat relative to the frame to adjust the distance between the first wheel rod and the second wheel rod;

an operation unit including a drive shaft rotatably mounted on the first side plate of the frame, a drive bevel gear secured on a first end of the drive shaft to rotate therewith and meshing with the driven bevel gear of the adjusting unit for rotating the driven bevel gear, and an operation handle secured on a second end of the drive shaft to rotate the drive shaft.

Further benefits and advantages of the present invention will become apparent after a careful reading of the detailed description with appropriate reference to the accompanying drawings.

DETAILED DESCRIPTION OF THE INVENTION

Figure 1:
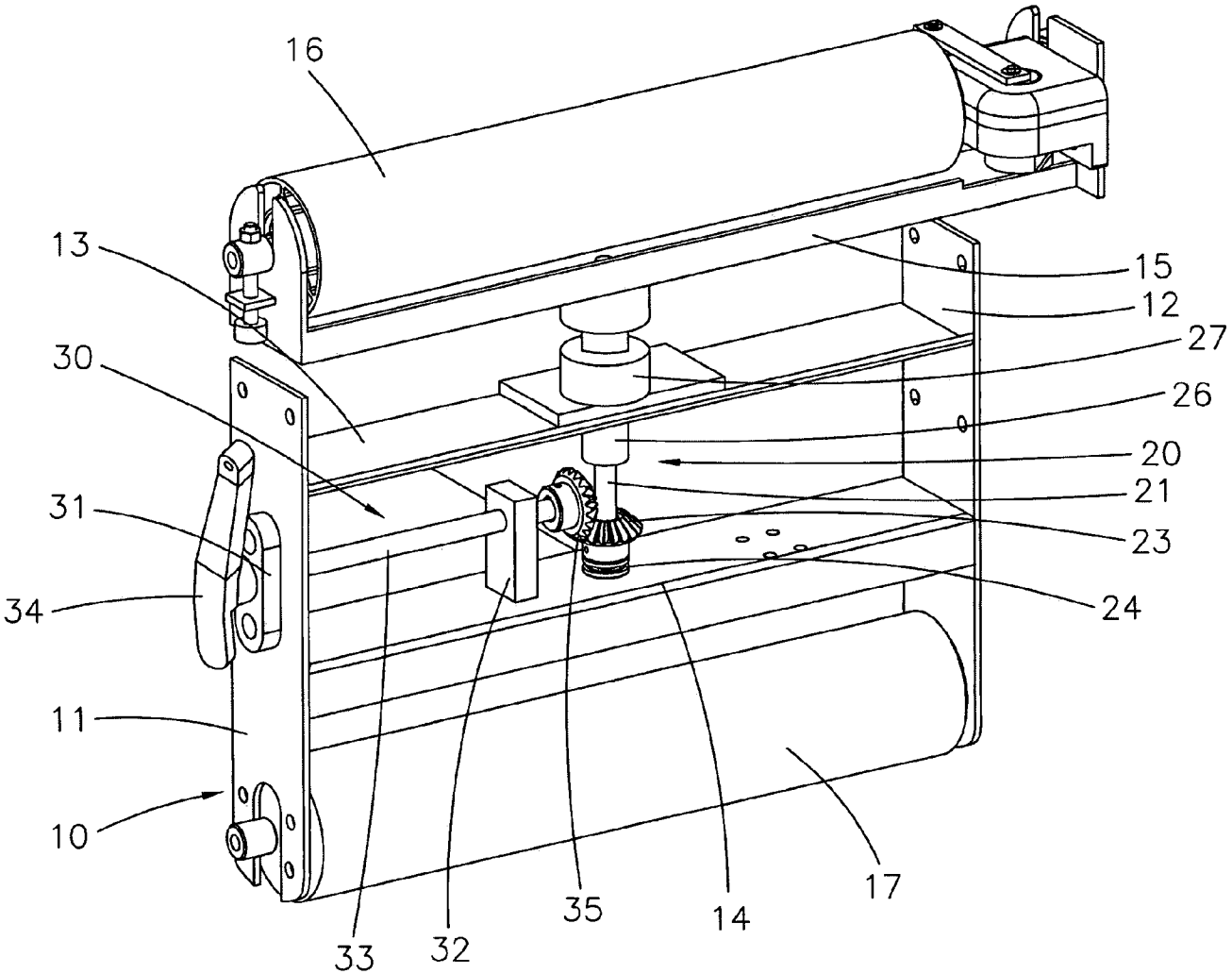
FIG. 1 is a perspective view of a belt sander in accordance with the preferred embodiment of the present invention.
Figure 2:
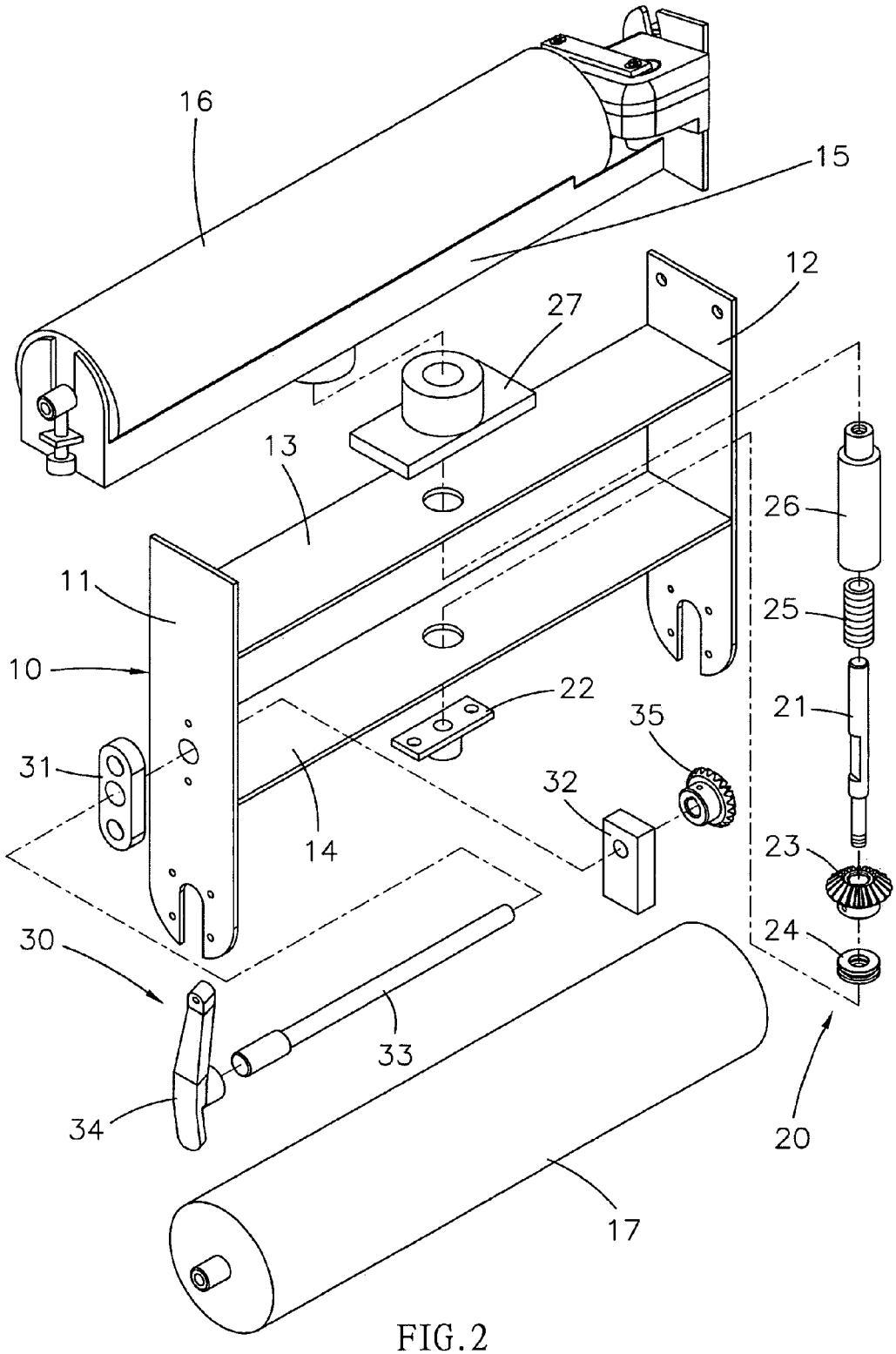
FIG. 2 is an exploded perspective view of the belt sander as shown in FIG. 1.
Figure 3:
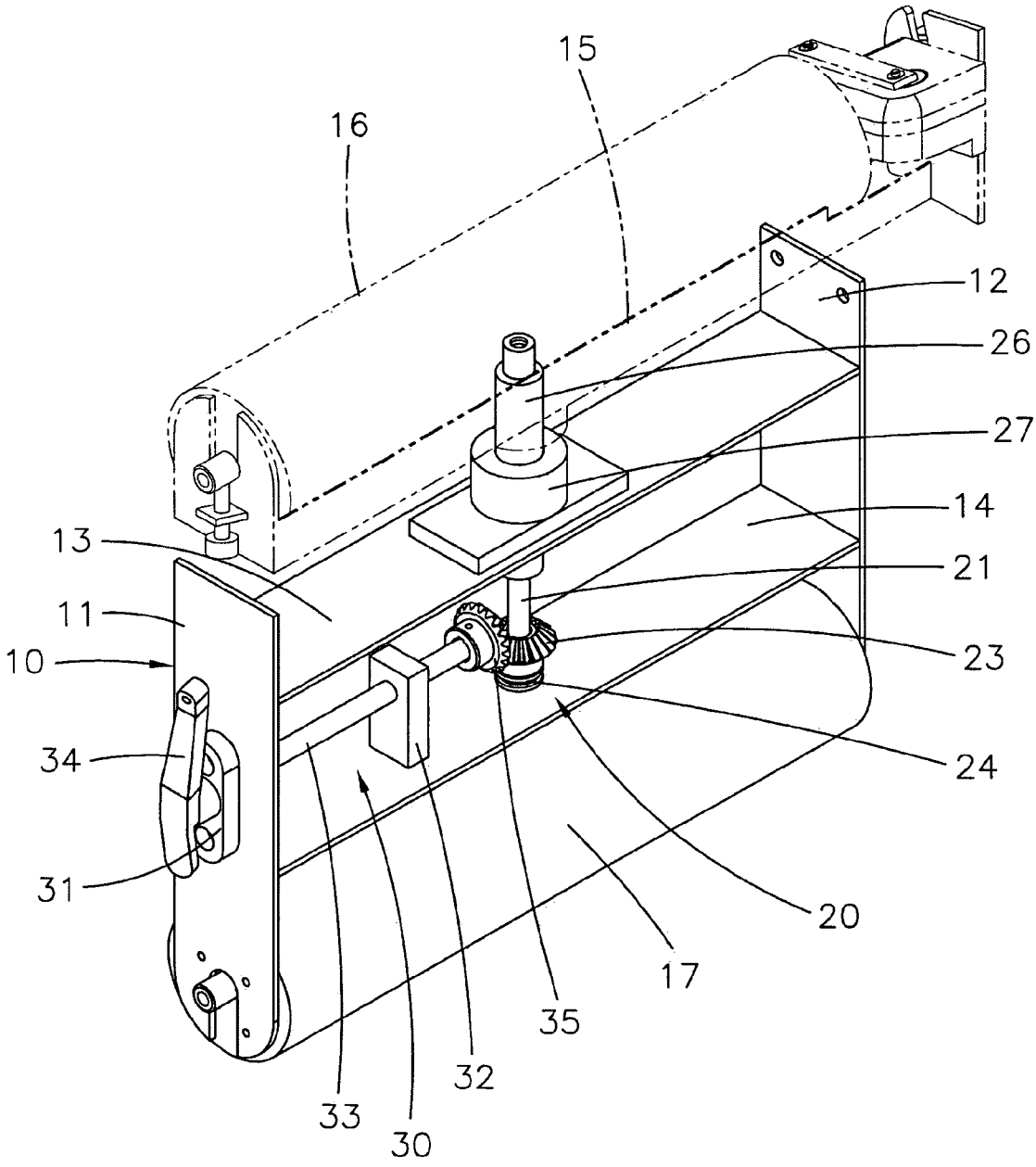
FIG. 3 is a schematic operational view of the belt sander as shown in FIG. 1.
Figure 4:
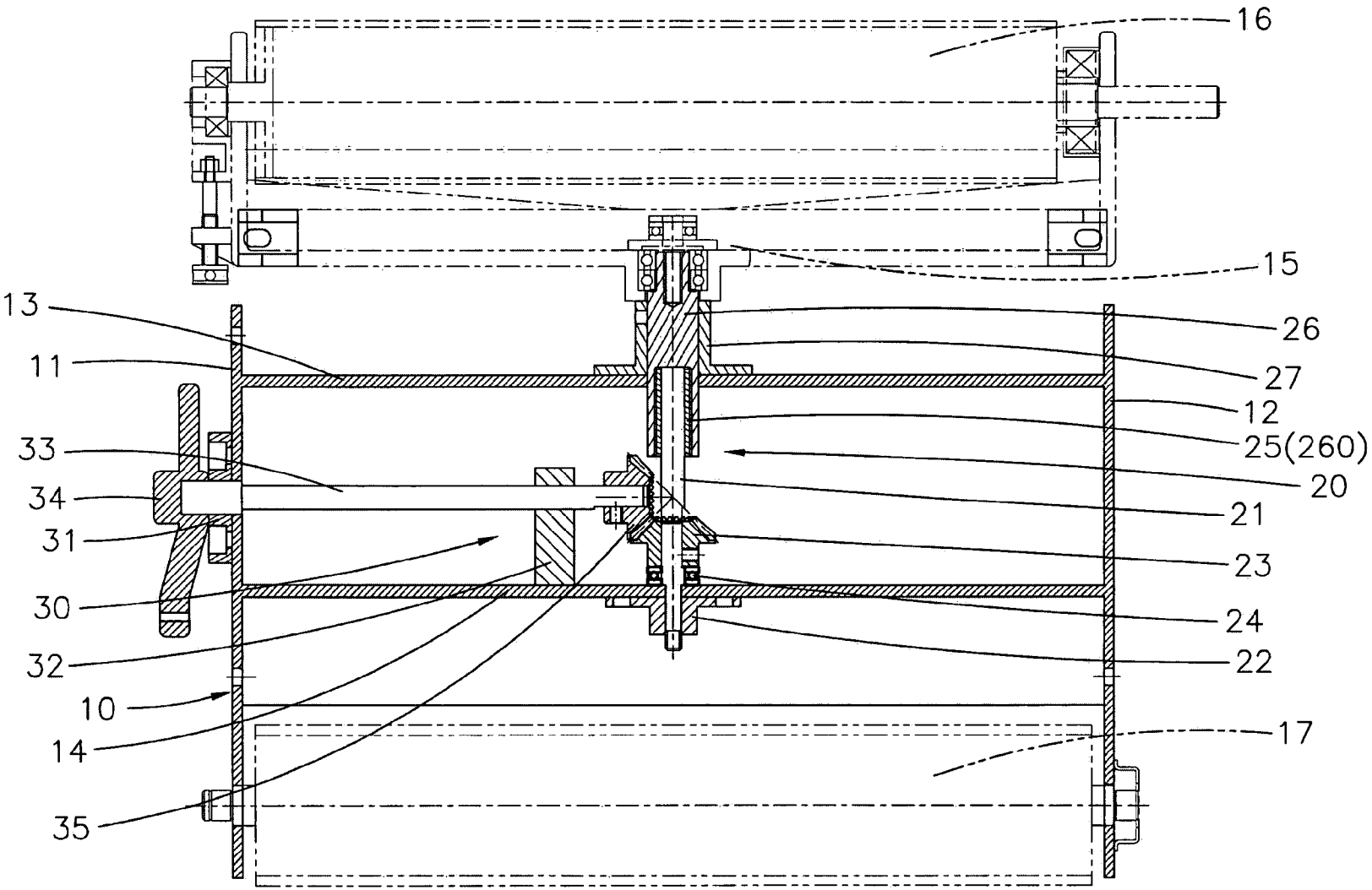
FIG. 4 is a front plan cross-sectional view of the belt sander as shown in FIG. 1.
Figure 5:
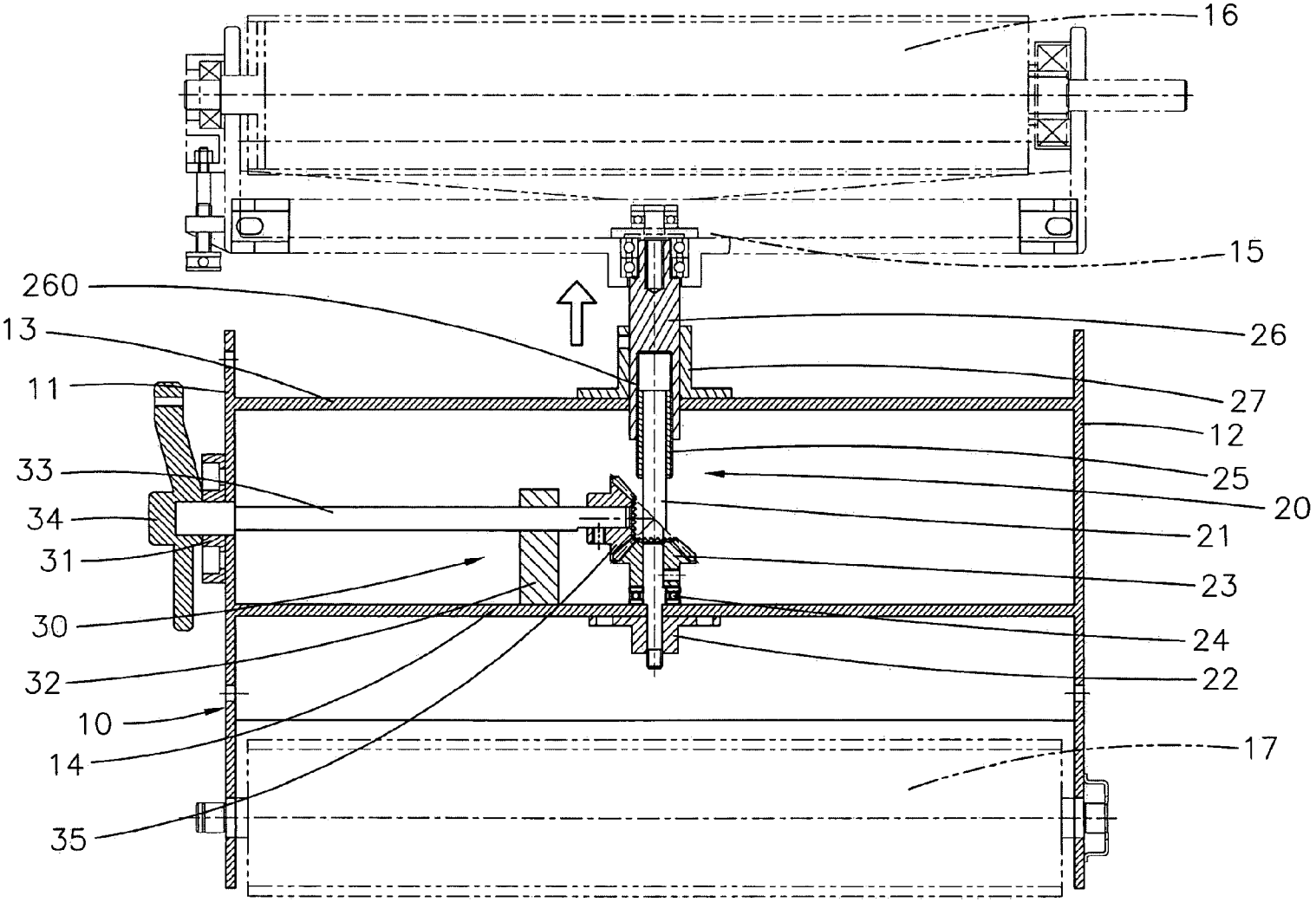
FIG. 5 is a schematic operational view of the belt sander as shown in FIG. 4.

Referring to the drawings and initially to FIGS. 1–3, a belt sander in accordance with the preferred embodiment of the present invention comprises a frame 10, a first wheel rod 16 mounted on a first end of the frame 10, a second wheel rod 17 mounted on a second end of the frame 10, and a sand belt (not shown) mounted between the first wheel rod 16 and the second wheel rod 17. Thus, the sand belt is driven by the first wheel rod 16 and the second wheel rod 17 to rotate at a high speed to grind a workpiece, such as a wooden material.

The frame 10 includes a first side plate 11, a second side plate 12 spaced from the first side plate 11, a first transverse plate 13 mounted between the first side plate 11 and the second side plate 12, and a second transverse plate 14 mounted between the first side plate 11 and the second side plate 12 and spaced from the first transverse plate 13. Each of the first transverse plate 13 and the second transverse plate 14 of the frame 10 is disposed at a horizontal state, and each of the first side plate 11 and the second side plate 12 of the frame 10 is disposed at an upright state.

A support seat 15 is located adjacent to and movable relative to the first transverse plate 13 of the frame 10, the first wheel rod 16 is mounted on the support seat 15 to move therewith, and the second wheel rod 17 is mounted between the first side plate 11 and the second side plate 12 of the frame 10 and located adjacent to the second transverse plate 14 of the frame 10. Thus, the first wheel rod 16 is movable relative to the second wheel rod 17 by movement of the support seat 15 to adjust the distance between the first wheel rod 16 and the second wheel rod 17 so as to adjust the tension of the sand belt. In addition, the support seat 15 is disposed at a horizontal state and separated from the first transverse plate 13 of the frame 10.

An adjusting unit 20 is mounted between the second transverse plate 14 of the frame 10 and the support seat 15 and includes a driven shaft 21 rotatably mounted on the second transverse plate 14 of the frame 10, a driven bevel gear 23 secured on the driven shaft 21 to rotate the driven shaft 21, a threaded rod 25 secured on the driven shaft 21 to rotate therewith, a slide rod 26 mounted on and movable by rotation of the threaded rod 25 and having a top end secured on a bottom face of the support seat 15 to move the support seat 15 relative to the frame 10 to adjust the distance between the first wheel rod 16 and the second wheel rod 17 so as to adjust the tension of the sand belt, a guide track 27 mounted on the first transverse plate 13 of the frame 10 for slidably receiving the slide rod 26 to facilitate movement of the slide rod 26, a radial bearing mounted on the driven shaft 21 and located between the driven bevel gear 23 and a top face of the second transverse plate 14 of the frame 10 to facilitate rotation of the driven bevel gear 23, and a mounting member 22 mounted on a bottom face of the second transverse plate 14 of the frame 10 for mounting a bottom end of the driven shaft 21 to facilitate rotation of the driven shaft 21.

The driven shaft 21 of the adjusting unit 20 is disposed at an upright state. The driven bevel gear 23 of the adjusting unit 20 is secured on a mediate portion of the driven shaft 21. The threaded rod 25 of the adjusting unit 20 is secured on a top end of the driven shaft 21. The slide rod 26 of the adjusting unit 20 is movably mounted on and extended through the first transverse plate 13 of the frame 10. The slide rod 26 has a bottom end formed with an inner thread 260 screwed onto the threaded rod 25.

An operation unit 30 is mounted between the first side plate 11 of the frame 10 and the adjusting unit 20 and includes a drive shaft 33 rotatably mounted on the first side plate 11 of the frame 10, a drive bevel gear 35 secured on a first end of the drive shaft 33 to rotate therewith and meshing with the driven bevel gear 23 of the adjusting unit 20 for rotating the driven bevel gear 23, an operation handle 34 secured on a second end of the drive shaft 33 to rotate the drive shaft 33, a support member 32 mounted on the second transverse plate 14 of the frame 10 to support the drive shaft 33, and a mounting member 31 mounted on an outer side of the first side plate 11 of the frame 10 for mounting the drive shaft 33 to facilitate rotation of the drive shaft 33. The drive shaft 33 of the operation unit 30 is disposed at a horizontal state. The second end of the drive shaft 33 of the operation unit 30 is protruded outward from the first side plate 11 of the frame 10.

Referring to FIGS. 1–5, the operation handle 34 of the operation unit 30 is rotated to rotate the drive shaft 33 which rotates the drive bevel gear 35 which rotates the driven bevel gear 23 which rotates the driven shaft 21 which rotates the threaded rod 25 to move the slide rod 26 by rotation of the threaded rod 25 so that the slide rod 26 is moved upward to move the support seat 15 upward relative to the frame 10 to lift the first wheel rod 16 relative to the second wheel rod 17 to increase the distance between the first wheel rod 16 and the second wheel rod 17 so as to tighten the sand belt.

Figure 7:
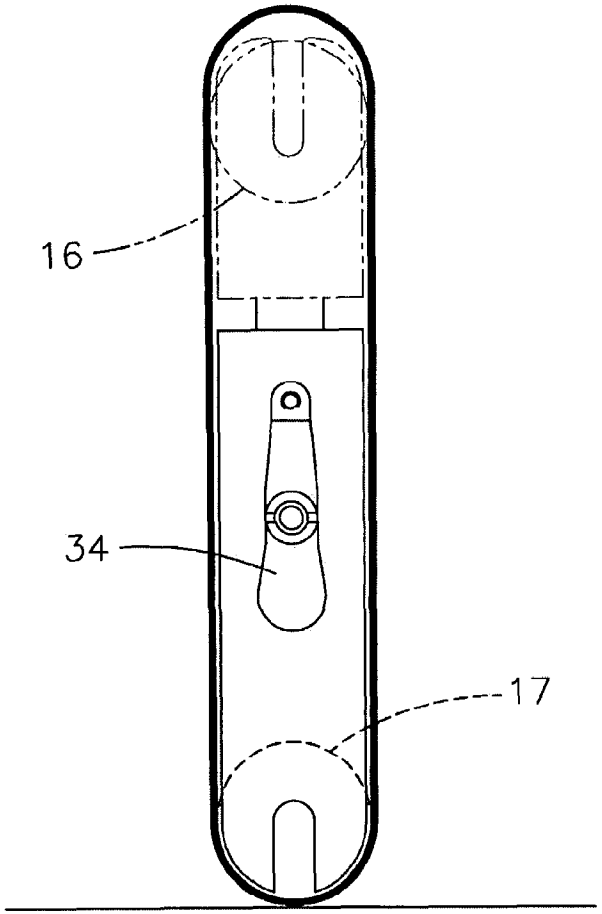
FIG. 7 is a schematic operational view of the belt sander as shown in FIG. 6.
Figure 6:
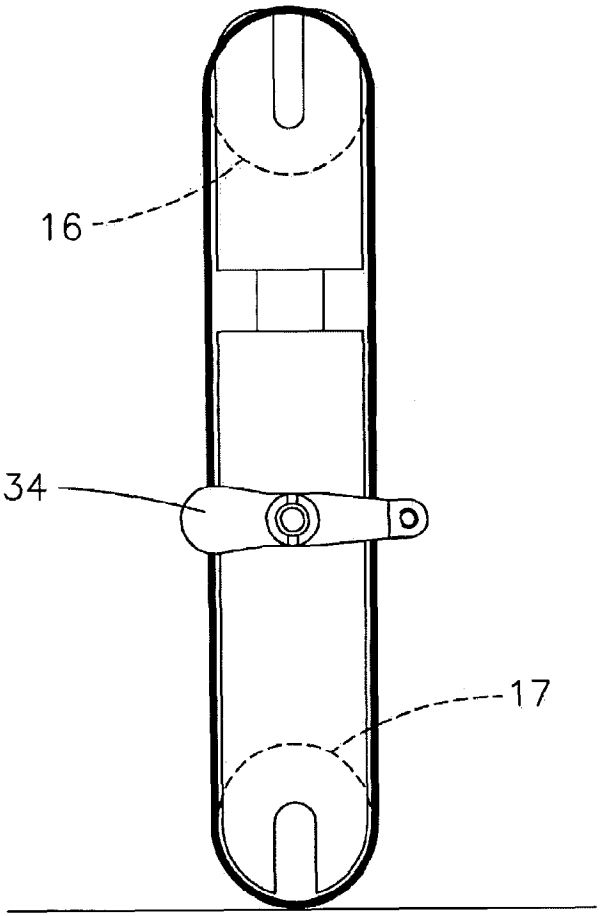
FIG. 6 is a side plan view of the belt sander as shown in FIG. 1.

Alternatively, referring to FIGS. 6 and 7 with reference to FIGS. 1–4, the operation handle 34 of the operation unit 30 is rotated reversely to rotate the drive shaft 33 which rotates the drive bevel gear 35 which rotates the driven bevel gear 23 which rotates the driven shaft 21 which rotates the threaded rod 25 to move the slide rod 26 by rotation of the threaded rod 25 so that the slide rod 26 is moved downward to move the support seat 15 downward relative to the frame 10 to lower the first wheel rod 16 relative to the second wheel rod 17 to shorten the distance between the first wheel rod 16 and the second wheel rod 17 so as to loosen the sand belt, thereby facilitating a user replacing the sand belt.

Accordingly, the operation handle 34 is rotated to rotate the drive shaft 33 which rotates the drive bevel gear 35 which rotates the driven bevel gear 23 which rotates the driven shaft 21 which rotates the threaded rod 25 to move the slide rod 26 by rotation of the threaded rod 25 so that the slide rod 26 is moved upward and downward to move the support seat 15 upward and downward relative to the frame 10 to move the first wheel rod 16 relative to the second wheel rod 17 to change the distance between the first wheel rod 16 and the second wheel rod 17 so as to adjust the tension of the sand belt. In addition, the user only needs to rotate the operation handle 34 of the operation unit 30 to change the distance between the first wheel rod 16 and the second wheel rod 17 so as to adjust the tension of the sand belt, thereby facilitating the user adjusting the tension of the sand belt, and thereby enhancing the working efficiency of the belt sander. Further, the user only needs to rotate the operation handle 34 of the operation unit 30 to shorten the distance between the first wheel rod 16 and the second wheel rod 17 so as to loosen the sand belt, thereby facilitating the user replacing the sand belt, and thereby enhancing the lifetime of the sand belt.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A belt sander, comprising:

a frame including a first side plate, a second side plate spaced from the first side plate, a first transverse plate mounted between the first side plate and the second side plate, and a second transverse plate mounted between the first side plate and the second side plate and spaced from the first transverse plate;

a support seat movable relative to the frame;

a first wheel rod mounted on the support seat to move therewith;

a second wheel rod mounted on the frame;

a sand belt mounted between the first wheel rod and the second wheel rod;

an adjusting unit including a driven shaft rotatably mounted on the second transverse plate of the frame, a driven bevel gear secured on the driven shaft to rotate the driven shaft, a threaded rod secured on the driven shaft to rotate therewith, and a slide rod mounted on and movable by rotation of the threaded rod and having a top end secured on a bottom face of the support seat to move the support seat relative to the frame to adjust the distance between the first wheel rod and the second wheel rod;

an operation unit including a drive shaft rotatably mounted on the first side plate of the frame, a drive bevel gear secured on a first end of the drive shaft to rotate therewith and meshing with the driven bevel gear of the adjusting unit for rotating the driven bevel gear, and an operation handle secured on a second end of the drive shaft to rotate the drive shaft.

2. The belt sander in accordance with claim 1, wherein the adjusting unit is mounted between the second transverse plate of the frame and the support seat.

3. The belt sander in accordance with claim 1, wherein the adjusting unit further includes a guide track mounted on the first transverse plate of the frame for slidably receiving the slide rod to facilitate movement of the slide rod.

4. The belt sander in accordance with claim 1, wherein the adjusting unit further includes a radial bearing mounted on the driven shaft and located between the driven bevel gear and a top face of the second transverse plate of the frame to facilitate rotation of the driven bevel gear.

5. The belt sander in accordance with claim 1, wherein the adjusting unit further includes a mounting member mounted on a bottom face of the second transverse plate of the frame for mounting a bottom end of the driven shaft to facilitate rotation of the driven shaft.

6. The belt sander in accordance with claim 1, wherein the operation unit is mounted between the first side plate of the frame and the adjusting unit.

7. The belt sander in accordance with claim 1, wherein the operation unit further includes a support member mounted on the second transverse plate of the frame to support the drive shaft.

8. The belt sander in accordance with claim 1, wherein the operation unit further includes a mounting member mounted on an outer side of the first side plate of the frame for mounting the drive shaft to facilitate rotation of the drive shaft.

9. The belt sander in accordance with claim 1, wherein the support seat is located adjacent to and movable relative to the first transverse plate of the frame.

10. The belt sander in accordance with claim 1, wherein the second wheel rod is mounted between the first side plate and the second side plate of the frame and located adjacent to the second transverse plate of the frame.

11. The belt sander in accordance with claim 1, wherein the support seat is disposed at a horizontal state and separated from the first transverse plate of the frame.

12. The belt sander in accordance with claim 1, wherein the driven bevel gear of the adjusting unit is secured on a mediate portion of the driven shaft.

13. The belt sander in accordance with claim 1, wherein the threaded rod of the adjusting unit is secured on a top end of the driven shaft.

14. The belt sander in accordance with claim 1, wherein the slide rod of the adjusting unit is movably mounted on and extended through the first transverse plate of the frame.

15. The belt sander in accordance with claim 1, wherein the slide rod has a bottom end formed with an inner thread screwed onto the threaded rod.

16. The belt sander in accordance with claim 1, wherein the driven shaft of the adjusting unit is disposed at an upright state.

17. The belt sander in accordance with claim 1, wherein the drive shaft of the operation unit is disposed at a horizontal state.

18. The belt sander in accordance with claim 1, wherein the second end of the drive shaft of the operation unit is protruded outward from the first side plate of the frame.

19. The belt sander in accordance with claim 1, wherein each of the first transverse plate and the second transverse plate of the frame is disposed at a horizontal state.

20. The belt sander in accordance with claim 1, wherein each of the first side plate and the second side plate of the frame is disposed at an upright state.

* * * * *